US005349376A

United States Patent [19]

Imaizumi et al.

[11] Patent Number: 5,349,376

[45] Date of Patent: Sep. 20, 1994

[54] PRINTING APPARATUS FOR PERFORMING OVERHEAD PROJECTOR PROCESSING

[75] Inventors: Mamoru Imaizumi; Fumio Morita, both of, Nagoya, Japan

[73] Assignee: Brother Kogyo Kabushiki Kaisha, Nagoya, Japan

[21] Appl. No.: 896,629

[22] Filed: Jun. 10, 1992

[30] Foreign Application Priority Data

Jun. 14, 1991 [JP] Japan ..... 3-143255

[51] Int. Cl.[5] ..... B41J 2/01

[52] U.S. Cl. ..... 347/16; 347/102; 346/25

[58] Field of Search ..... 346/1.1, 25, 140 R, 346/75; 219/216; 355/290

[56] References Cited

U.S. PATENT DOCUMENTS

| | | | |
|---|---|---|---|
| 4,549,803 | 10/1985 | Ohno et al. | 219/216 X |
| 4,801,473 | 1/1989 | Creagh et al. | 346/140 R |
| 4,853,706 | 8/1989 | Van Brimer et al. | 427/164 |
| 4,889,761 | 12/1989 | Titterington et al. | 346/1.1 X |
| 4,928,761 | 5/1990 | Higashi | 355/290 |
| 5,182,571 | 1/1993 | Creagh et al. | 346/1.1 |

FOREIGN PATENT DOCUMENTS

| | | | |
|---|---|---|---|
| 488724 | 6/1992 | European Pat. Off. | 346/75 |
| 02-179771 | 7/1990 | Japan | 346/140 R |
| 03-146352 | 6/1991 | Japan | 346/140 R |

*Primary Examiner*—Benjamin R. Fuller
*Assistant Examiner*—John Barlow
*Attorney, Agent, or Firm*—Oliff & Berridge

[57] ABSTRACT

A printing apparatus that enhances light transmittance of overhead projector (OHP) sheets while preventing any deterioration in printing speed. The apparatus can compare a divider assembly located between a printing unit and a printed paper tray. The divider assembly feeds print media selectively to an OHP processing unit or to the printed paper tray. An OHP sheet printed in color is fed by the divider assembly to the OHP processing unit which prepares the sheet for OHP applications. An OHP sheet printed in monochrome is fed by the divider assembly to the printed paper tray without passage through the OHP processing unit.

19 Claims, 10 Drawing Sheets

PRINTING APPARATUS FOR PERFORMING OVERHEAD PROJECTOR PROCESSING

BACKGROUND OF THE INVENTION

1. Field of the Invention

The present invention relates to a printing apparatus and, more particularly, to a printing apparatus capable of performing overhead projector (OHP) processing for the purpose of enhancing light transmittance of ink in printing on an OHP sheet.

2. Description of Related Art

FIGS. 7(*a*) and 7(*b*) are views showing how a typical prior art ink jet printer operates. As depicted in FIG. 7(*a*), a printer head 17 comprises nozzles 63 filled with ink 62 and piezoelectric elements 64 furnished on the walls of the nozzles 63. On the surface of the printer head 17, the surface tension of the ink 62 prevents it from oozing out of the head 17.

A print command from a CPU 37 applies a voltage to appropriate piezoelectric elements 64. The voltage deforms the piezoelectric elements 64 in a convex fashion toward the corresponding nozzles 63, pressurizing the ink 62 within the nozzles 63, as illustrated in FIG. 7(*b*). When pressurized, a part of the ink 62 spurts out of the printer head 17 and adheres to a sheet 14.

When characters and figures are printed on an overhead projector (OHP) sheet 68, the ink 62 sticks protrusively on the surface thereof, as shown in FIG. 8(*a*). The protrusion of the ink 62 causes the light transmitting therethrough to scatter. The scattering of the transmitted light makes it difficult to obtain vivid colors of the characters and figures which are projected from the OHP sheet 68 onto a screen.

One method to solve the above problem is disclosed in U.S. Pat. No. 4,801,473. This method involves using a coating roller arrangement or the like to apply a coat of special coating material 70 over the printed surface of the OHP sheet 68. The coating smooths out the ink protrusions on the sheet surface after printing and eliminates the scattering of the light that passes through the OHP sheet 68, as shown in FIG. 8(*b*), whereby vivid colors of the print are obtained upon projection on the screen.

Another method proposed to address the same problem is to use a pressure roller assembly or the like to pressurize the printed OHP sheet 68. The roller flattens the protrusions of the ink 62, as illustrated in FIG. 8(*c*). The flattened ink eliminates the scattering of the transmitted light and ensures vivid colors of the print as it is projected on the screen.

Yet another method disclosed in U.S. Pat. No. 4,853,706 involves heating the printed OHP sheet 68 above a melting point of the ink 62. When heated, the ink 62 liquefies and spreads over the OHP sheet 68. When the ink 62 is cooled, the surface thereof becomes smooth and does not cause the transmitting light to scatter, as shown in FIG. 8(*d*). This also ensures vivid colors of the print as it is projected onto the screen.

One disadvantage of the proposed prior art methods is that it generally takes disproportionately longer for the printing apparatus operating using these methods to perform the so-called OHP processing than the time necessary to print the OHP sheet 68. The OHP processing, as described above, refers to the measures taken to render vivid the colors of the ink 62 as the print is projected from the OHP sheet 68 onto the screen. Another disadvantage of the prior art is that while the OHP sheet 68 printed in black obviously need not undergo OHP processing for higher transmittance, the prior art apparatus deals with both monochromatic (i.e., black) and multiple color sheets indiscriminately. The OHP processing of the prior art thus reduces a printing speed unavoidably and unnecessarily.

SUMMARY OF THE INVENTION

It is therefore an object of the present invention to overcome the above-described drawbacks and disadvantages of the prior art and to provide a printing apparatus that enhances the light transmittance of its print on OHP sheets while minimizing reduction in printing speed.

In carrying out the invention and according to one aspect thereof, there is provided a printing apparatus comprising: printing means for performing printing in a plurality of colors including black; overhead projector-oriented processing means for enhancing the light transmittance of an overhead projector-ready sheet on which the printing means prints data; judging means for making one of two judgments, one judgment being that the data printed on the overhead projector-ready sheet are in black only, the other judgment being that the data printed on the overhead projector-ready sheet are in a plurality of colors; and controlling means for controlling the overhead projector-oriented processing means in accordance with the judgment made by the judging means; wherein the controlling means activates the overhead projector-oriented processing means if the judging means finds the print data to be in a plurality of colors while the controlling means deactivates the overhead projector-oriented processing means if the judging means finds the print data to be in black alone.

The inventive printing apparatus operates as follows. When the judging means judges that the data printed on the OHP sheet are in a plurality of colors, the controlling means causes the overhead projector-oriented processing means to perform its OHP processing accordingly. When the judging means judges that the data printed on the OHP sheet are in black only, the controlling means inhibits the OHP-oriented processing means from carrying out its OHP processing.

Further objects and advantages of this invention will become apparent from consideration of the following description and appended drawings.

BRIEF DESCRIPTION OF THE DRAWINGS

The invention will be described with reference to the following figures, wherein.

DESCRIPTION OF THE PREFERRED EMBODIMENTS

Figure 1:
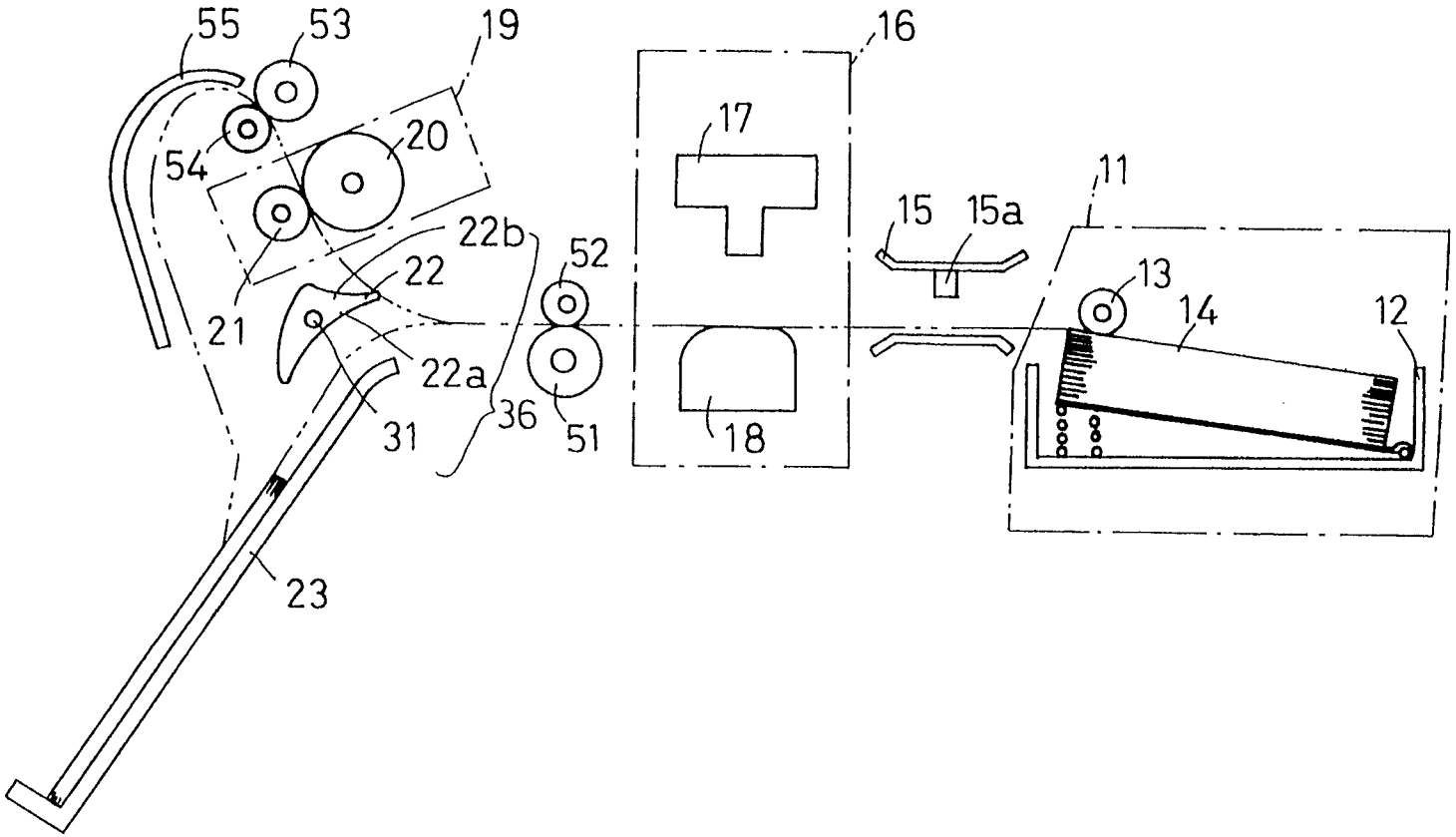
FIG. 1 is a schematic cross-sectional view of a printing apparatus in a first preferred embodiment according to the invention.

Preferred embodiments of the invention will now be described with reference to the accompanying drawings. FIG. 1 is a schematic cross-sectional view showing the basic construction of an ink jet printer embodying the invention. In the embodiment of FIG. 1, a paper feeding unit 11 has a cassette 12 and a separating roller 13. The cassette 12 has a plurality of print media 14 stacked inside. The separating roller 13 is located so as to contact the uppermost print medium 14 in the cassette 12. Rotating clockwise in FIG. 1, the separating roller 13 feeds the print medium 14 from the top of the stack to a printing unit 16 through a paper feeding guide 15 located between the paper feeding unit 11 and the printing unit 16.

The paper feeding guide 15 is equipped with a reflection sensor 15*a* that determines whether the print medium 14 sent from the cassette 12 is an ordinary sheet or an OHP sheet. The sensor 15*a* is of a known construction comprising a light emitting device and a light receiving device. In operation, the light receiving device detects the light emitted by the light emitting device as reflected from the print medium 14. The intensity of the reflected light allows the sensor 15*a* to determine if the print medium 14 is an ordinary sheet or an OHP sheet.

Figure 7:
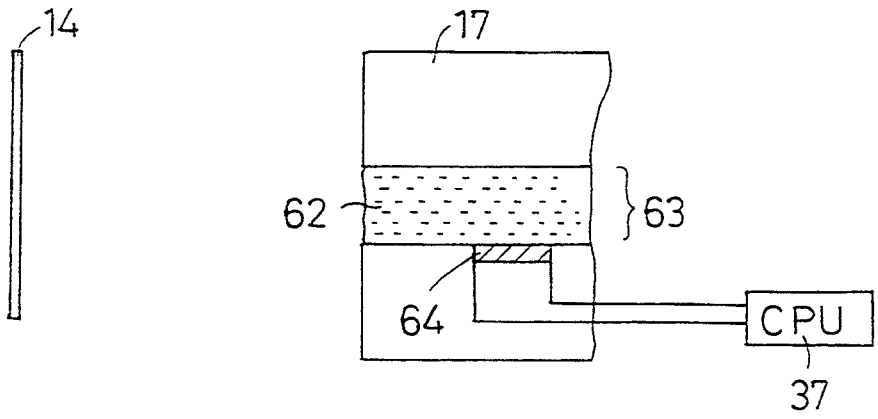
FIG.7 (a) PRIOR ART
FIGS. 7(*a*)–7(*b*) are cross-sectional views illustrating the construction of a typical printer head.
Figure 7:
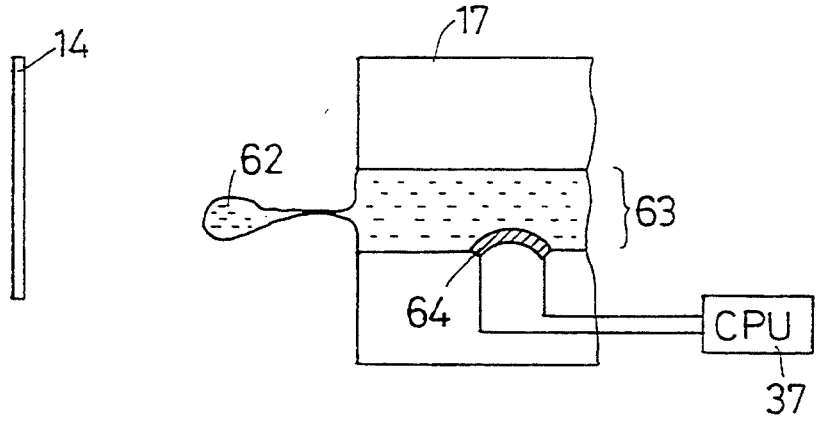
FIG.7 (b) PRIOR ART
Figure 8:
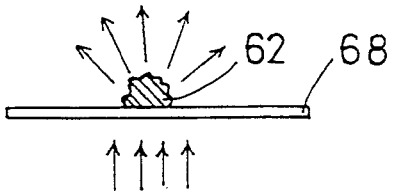
FIG.8 (a) PRIOR ART
FIGS. 8(*a*)–8(*d*) are views describing how the protrusions of ink printed on OHP sheets affect the light transmittance thereof.
Figure 8:
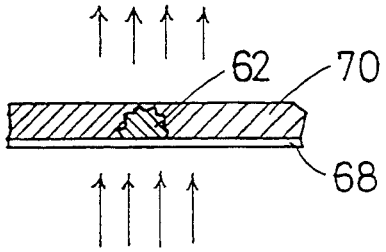
FIG.8 (b) PRIOR ART
Figure 8:
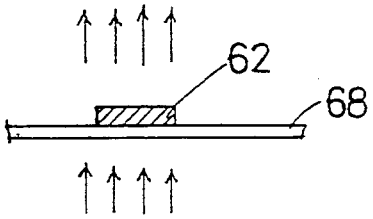
FIG.8 (c) PRIOR ART
Figure 8:
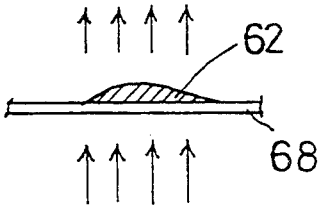
FIG.8 (d) PRIOR ART

The printing unit 16 is located downstream of the paper feeding unit 11 and has a printer head 17 and a platen 18. The printer head 17 is the same in structure as that described in connection with the prior art. As shown in FIG. 7(*a*), the printer head 17 includes a plurality of nozzles 63 filled with ink 62 and piezoelectric elements 64 furnished on the walls of the nozzles 63. The nozzles 63 print characters and symbols in a dot matrix pattern. The printer head 17 is positioned perpendicular to the print medium 14 fed from the paper feeding unit 11.

The platen 18, located opposite to the printer head 17, supports against the printer head 17 the print medium 14 that comes from the paper feeding unit 11. When a voltage is applied to appropriate piezoelectric elements 64 in the printer head 17, the elements 64 are deformed in a convex fashion toward the corresponding nozzles 63. The deforming action pressurizes the ink 62 inside the nozzles 63, causing a part of the ink therein to spurt out of the printer head 17 and adhere to the print medium 14.

Downstream of the printing unit 16 are a pair of paper feeding rollers 51 and 52 for sending the print medium 14 from the printing unit 16 to a divider assembly 36, to be described later.

An OHP processing unit 19 is located downstream of the printing unit 16 and is equipped with a pressure roller 20 and a nip pressure roller 21. Using the two rollers, the OHP processing unit 19 pressure-feeds the print medium 14 coming from the printing unit 16. The pressing action of the rollers flattens the ink protruding on the OHP sheet (hereinafter referred to as "OHP processing").

The divider assembly 36 is positioned between the printing unit 16 and the OHP processing unit 19. The divider assembly 36 is set ordinarily so as to guide the print medium 14 directly into a printed paper tray 23.

Figure 2:
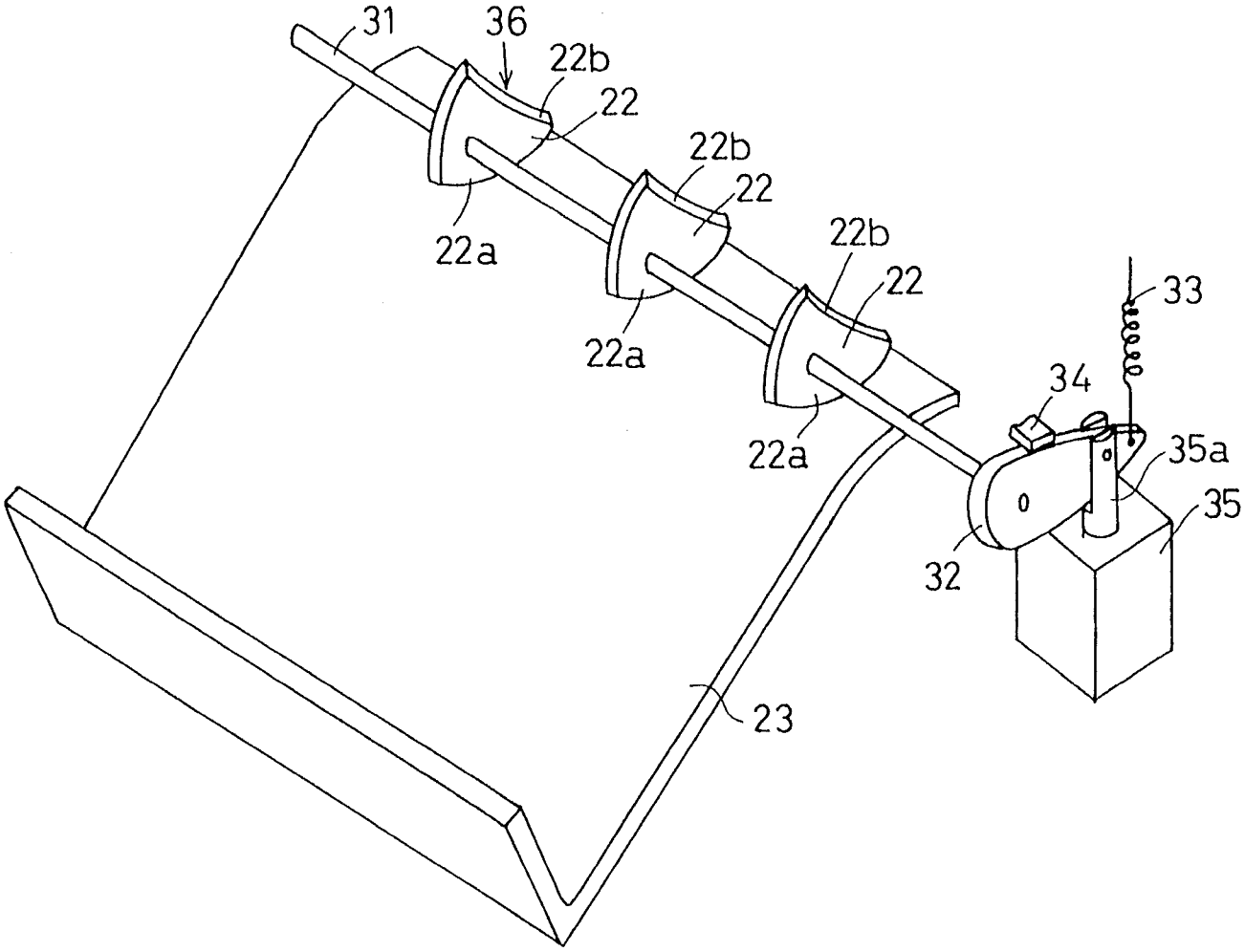
FIG. 2 is an enlarged perspective view of a divider assembly in the first embodiment.

Described below is the construction of the divider assembly 36 with reference to FIG. 2. FIG. 2 is an enlarged perspective view of the divider assembly 36. As illustrated, the assembly 36 comprises a divider shaft 31, a solenoid lever 32, a tension spring 33, a stopper 34, a solenoid 35, and a plurality of dividers 22.

The divider shaft 31 is rotatably supported by the side walls, not shown, of the ink jet printer. The shaft 31 has the plurality of dividers 22 attached thereto. One end of the solenoid lever 32 is fixedly attached to one end of the divider shaft 31. The solenoid lever 32 is actuated by the tension spring 33 to contact the stopper 34. The other end of the solenoid lever 32 is connected to a working shaft 35*a* of the solenoid 35.

When the solenoid 35 is turned off, the solenoid lever 32 actuated by the tension spring 33 stays in contact with the stopper 34. The lower surfaces 22*a* of the dividers 22 are positioned so as to allow the print medium 14 printed by the printing unit 16 to enter the printed paper tray 23. When the solenoid 35 is turned on to move the working shaft 35*a* downward in FIG. 2, the solenoid lever 32, the divider shaft 31 and the dividers 22 rotate clockwise. The clockwise rotation causes the upper surfaces 22*b* of the dividers 22 to cut off the paper feeding route between the printing unit 16 and the printed paper tray 23, thereby guiding the print medium 14 into the OHP processing unit 19.

The printed paper tray 23 is located downstream of both the OHP processing unit 19 and the dividers 22. All print media 14 coming directly from the printing unit 16 or fed via the OHP processing unit 19 are accommodated in the tray 23. Between the printed paper tray 23 and the OHP processing unit 19 are disposed a pair of paper feeding rollers 53 and 54 as well as a guide 55. The paper feeding rollers 53 and 54 move forward the print medium 14 coming from the OHP processing unit 19. The guide 55 leads the print medium 14 coming out of the paper feeding rollers 53 and 54 into the printed paper tray 23.

Figure 3:
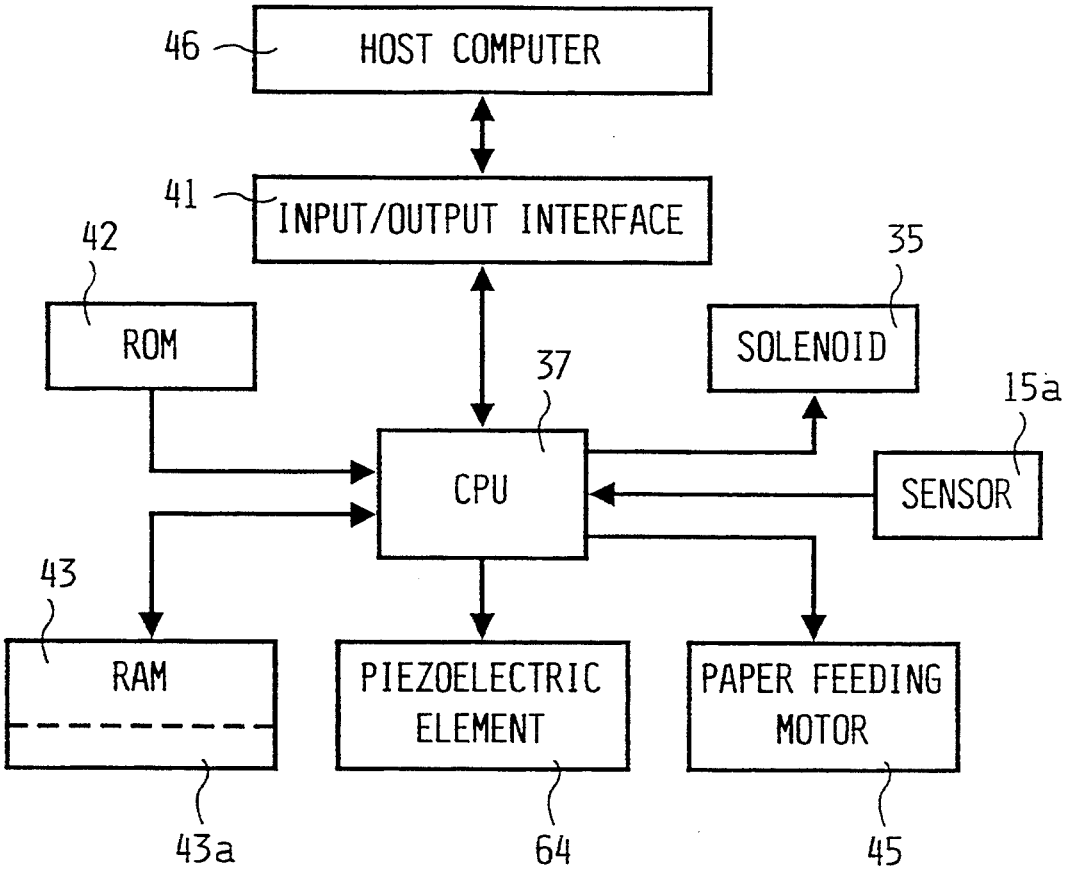
FIG. 3 is a block diagram showing the electrical construction of the printing apparatus in the first embodiment.

FIG. 3 is a block diagram showing the electrical construction of the ink jet printer embodying the invention. In FIG. 3, a CPU 37 for controlling the ink jet printer is connected to an input/output interface 41, a ROM 42, a RAM 43, the piezoelectric elements 64 of the printing head 17, the sensor 15*a*, a paper feeding motor 45, and the solenoid 35.

A host computer 46 is connected to the CPU 37 via the input/output interface 41. The host computer 46 supplies the CPU 37 with monochrome designation data, color designation data and print data. The monochrome designation data specify that printing is to be performed in black alone. The color designation data specify that printing is to be carried out in a plurality of colors. The print data represent characters, symbols and other print elements to be printed.

The ROM 42 stores various printer control programs and the dot patterns corresponding to the print data mentioned above. The RAM 43 temporarily accommodates the monochrome designation data, color designation data and print data output by the host computer 46. The RAM 43 also temporarily stores intermediate data being generated during printing. Furthermore, the RAM 43 includes a flag area 43*a* that holds a flag F indicating whether or not to guide the print medium 14 into the OHP processing unit 19.

The sensor 15*a* outputs one of two signals to the CPU 37. One signal tells the CPU 37 that the print medium 14 fed to the printing unit 16 is an ordinary sheet. The other signal tells the CPU 37 that the print medium 14 reaching the printing unit 16 is an OHP sheet.

The paper feeding motor 45 is connected to and rotates the separating roller 13 or the pair of paper feeding rollers 51 and 52, and the pair of paper feeding rollers 53 and 54. The solenoid 35 is turned on or off in accordance with the color or monochrome designation data supplied from the host computer 46.

Figure 4:
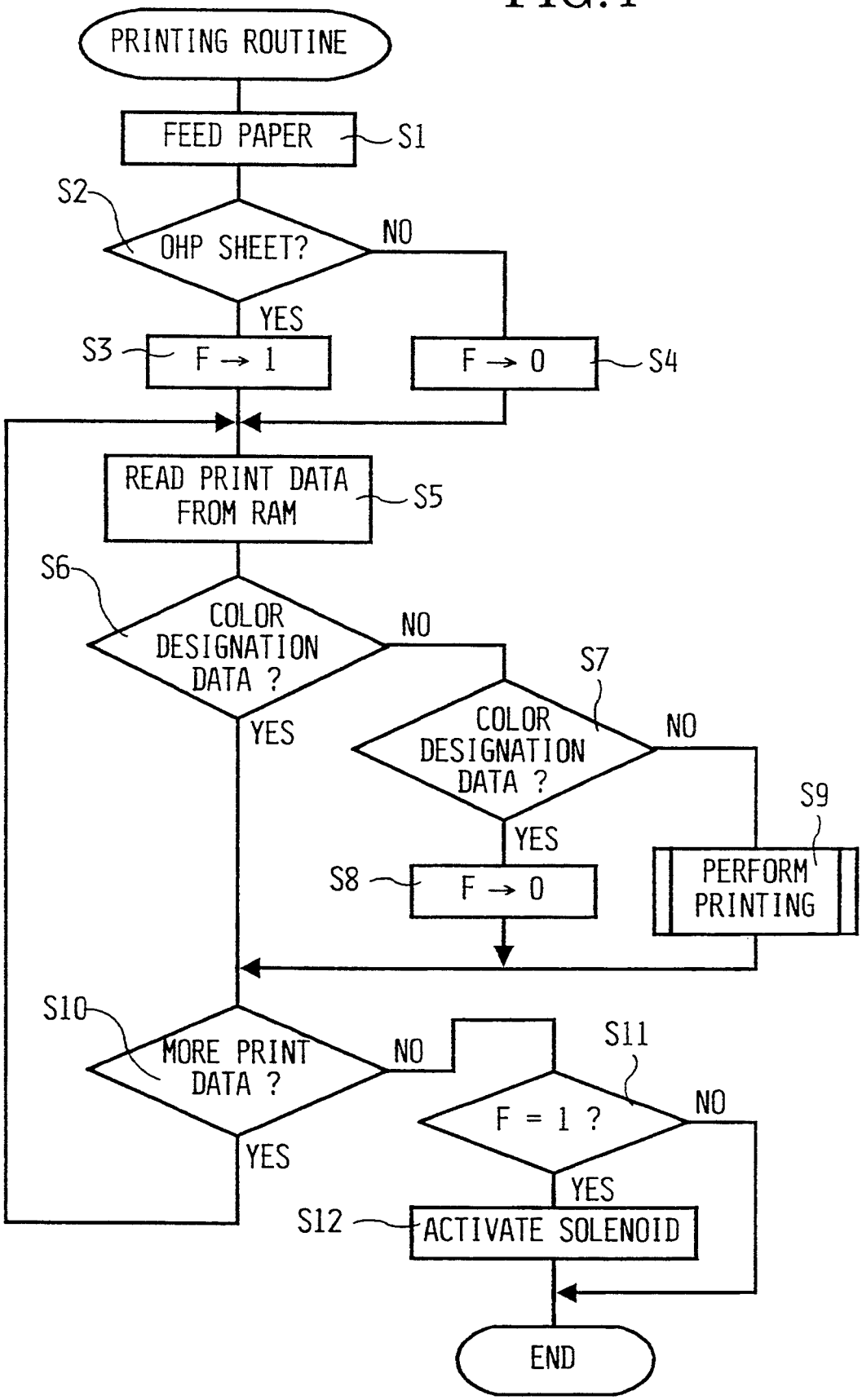
FIG. 4 is a flowchart depicting how the printing apparatus in the first embodiment according to the invention performs printing.

The operation of the ink jet printer constituted as described above will be explained below referring to FIG. 4.

The host computer 46 first outputs the color or monochrome designation data as well as the print data. The CPU 37 allows the output data to be stored consecutively into the RAM 43. When the host computer 46 issues a print command, a printing routine for printing the print data in the RAM 43 is executed through the steps shown in FIG. 4.

In step S1, the CPU 37 activates the paper feeding motor 45 to turn the separating roller 13 clockwise as shown in FIG. 1, thereby sending the print medium 14 at the top of the paper stacked in the cassette 12 toward the printing unit 16.

Having left the cassette 12, the print medium 14 faces the sensor 15*a* on its way to the printing unit 16. This is where step S2 is entered. In step S2, the sensor 15*a* determines whether the print medium 14 is an ordinary sheet or an OHP sheet. If the print medium 14 is determined to be an OHP sheet ("YES" decision in step S2), the CPU 37 enters step S3 and sets the flag F to "1." If the print medium 14 is determined to be an ordinary sheet ("NO" decision in step S2), the CPU 37 goes to step S4 and sets the flag F to "0."

Having executed step S3 or S4, the CPU 37 enters step S5 and reads the print data from the RAM 43. If the print data are found to be color designation data ("YES" decision in step S6), the CPU 37 goes to step S10, to be described later. If the print data are found to be monochrome designation data ("NO" decision in step S6, "YES" decision in step S7), the CPU 37 sets the flag F to "0" in step S8 before reaching step S10. If the read-out print data are data other than color designation data or monochrome designation data ("NO" decision in steps S6 and S7), the data are character data. The printing process involves reading from the ROM 42 the dot pattern corresponding to the character data, driving the appropriate piezoelectric elements 64 according to the dot pattern, and carrying out other printing-related operations so as to print out the data (step S9). Step S9 is followed by step S10.

If steps S2 through S8 confirm that the print medium 14 is an OHP sheet and that color printing is to be performed, the flag F is set to "1". If the print medium 14 is found to be an OHP sheet and if monochrome printing is to be carried out, the flag F is set to "0". If the print medium 14 is judged to be an ordinary sheet, the flag F is set to "0" regardless of color or monochrome printing being selected.

In step S10, the CPU 37 checks to see if the RAM 43 still contains print data to be read out. If the RAM 43 is found to contain more print data ("YES" decision in step S10), steps 5 through 10 are repeated. If the RAM 43 is found to contain no more print data ("NO" decision in step S10), step S11 is reached. In step S11, a check is made to see if the flag F in the flag area of the RAM 43 is set to "1".

If the flag F is found to be "1" ("YES" decision in step S11), the CPU 37 goes to step S12. In step S12, the CPU 37 drives the solenoid 35 of the divider assembly 36 for a predetermined period of time. This causes the working shaft 35*a* to move downward in FIG. 2, rotating clockwise the solenoid lever 32, divider shaft 31 and dividers 22. The clockwise rotation causes the upper surfaces 22*b* of the dividers 22 to cut off the paper feeding route between the printing unit 16 and the printed paper tray 23. As a result, the print medium 14, after printing is performed thereon, is guided along the upper surfaces 22*b* of the dividers 22 to the OHP processing unit 19.

The above-mentioned predetermined time in which the CPU 37 drives the solenoid 35 is a time long enough to allow the tip of the OHP sheet to pass through the paper feeding rollers 51 and 52 and reach the pressure roller 20 and nip pressure roller 21.

Having reached the OHP processing unit 19, the print medium 14 is pressed between the pressure roller 20 and the nip pressure roller 21. The pressing action flattens the ink printed on the print medium 14. With its ink protrusions flattened by the OHP processing unit 19, the print medium 14 is discharged to the printed paper tray 23 by the paper feeding rollers 53 and 54 along the guide 55.

If, in step S11, the flag F is found to be "0" ("NO" decision), the CPU 37 does not drive the solenoid 35. Consequently, the print medium 14 after print is led along the lower surfaces 22*a* of the dividers 22 into the printed paper tray 23.

As described, the ink jet printer embodying the invention automatically detects the OHP sheet printed in color, and forwards it to the OHP processing unit 19. The OHP processing unit 19 flattens any ink protrusions that may exist on the OHP sheet for higher light transmittance.

Where an ordinary sheet is printed in color or in monochrome (blank) or where an OHP sheet is printed in monochrome, the ink jet printer guides the printed sheet directly into the printed paper tray 23 without passage through the OHP processing unit 19.

All OHP sheets which are printed in color and which need OHP processing are always fed to the OHP processing unit 19. The OHP processing enhances the light transmittance of the ink printed on the sheet so that the projection of the print on the screen will be clear and vivid. The ordinary sheets not requiring OHP processing and the OHP sheets printed in monochrome are ejected out of the printing apparatus without undergoing OHP processing. Thus, a printing speed of the printer is not reduced unnecessarily.

Figure 5:
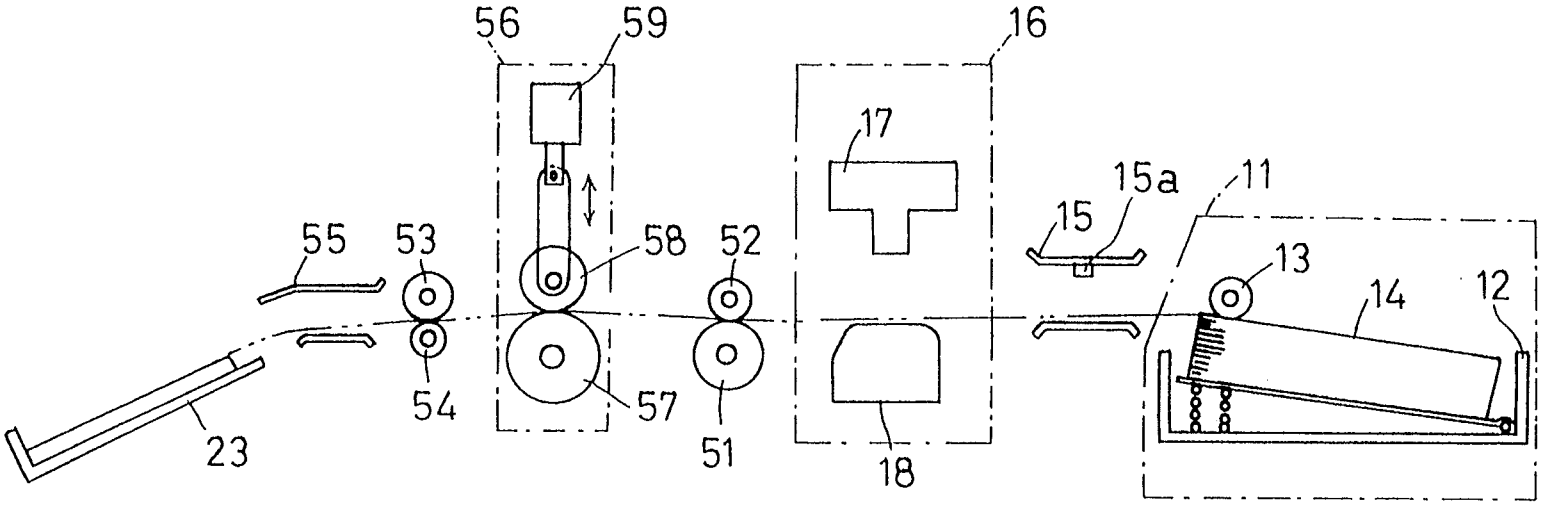
FIG. 5 is a schematic cross-sectional view of a printing apparatus in a second embodiment according to the invention.

The above description of the embodiment should not be construed as limiting the scope of the invention, but as merely illustrating one aspect thereof. Of many apparently different embodiments of this invention, one modification is shown in FIG. 5. This is a schematic cross-sectional view of the modification. Parts like or corresponding to those of the printer in the preceding embodiment are denoted by the same numerals, and any repetitive description thereof is omitted.

What makes the modification of FIG. 5 different from the preceding embodiment is that the modification has a differently constructed OHP processing unit and has eliminated the divider assembly 36. The OHP processing unit 56 of the modification comprises a pressure roller 57 rotated by the paper feeding motor 45, a nip pressure roller 58 detachably supported by the pressure roller 57, and a solenoid 59 that presses the nip pressure roller 58 against the pressure roller 57 or detaches the former from the latter.

When the solenoid 59 remains off, the nip pressure roller 58 is pressed against the pressure roller 57. The pressure roller 57 and the nip pressure roller 58 grab therebetween and move forward the print medium 14 coming from the paper feeding rollers 51 and 52. When the solenoid 59 is turned on, the nip pressure roller 58 is detached from the pressure roller 57. The print medium 14 sent from the paper feeding rollers 51 and 52 passes through the OHP processing unit 56 without being pressurized.

Figure 6:
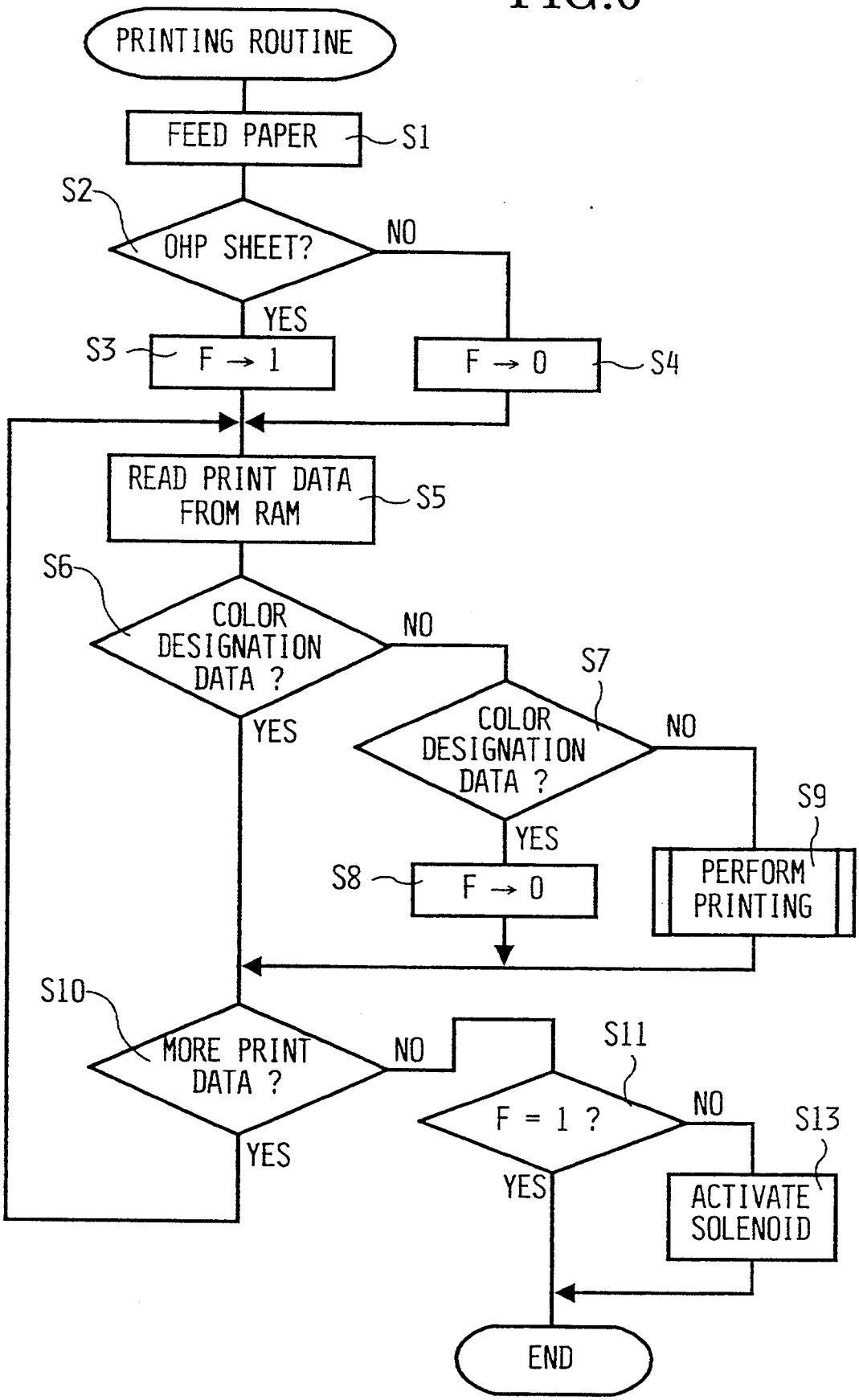
FIG. 6 is a flowchart showing how the printing apparatus in the second embodiment carries out printing.

How the modification of FIG. 5 works will now be described with reference to the flowchart of FIG. 6. This flowchart is the same as that in FIG. 4 except that the process of step S12 is different. The description of steps S1 through S11 is thus omitted.

When the flag F is found to be "1," the solenoid 59 remains turned off. Thus, the nip pressure roller 58 stays pressed against the pressure roller 57. The OHP sheet printed in color is pressed between the pressure roller 57 and the nip pressure roller 58. The pressing action flattens the ink printed on the OHP sheet.

When the flag F is found to be "0," the solenoid 59 is activated for a predetermined period of time. During that period, the nip pressure roller 58 is detached from the pressure roller 57. The OHP sheet printed in monochrome or ordinary sheet is discharged into the printed paper tray 23 without undergoing the pressing action. Because the OHP sheet or ordinary sheet at this point is not subject to the OHP processing, the paper feeding speed of the paper feeding rollers 51 through 54 is higher than the paper feeding speed if the OHP processing needs to be carried out.

The above-mentioned predetermined period in which the solenoid 59 is activated is a time long enough for the OHP sheet or ordinary sheet to go past the pressure roller 57 and the nip pressure roller 58.

In the same way as the ink jet printer in the preceding embodiment of FIG. 1, the ink jet printer in the modification of FIG. 5 allows all OHP sheets printed in color to always undergo OHP processing in the OHP processing unit 56 for the OHP processing required. The OHP processing enhances the light transmittance of the printed ink so as to render vivid the colors of the print upon projection on the screen. In addition, the ink jet printer in the modification allows the ordinary sheets not requiring any OHP processing and the OHP sheets printed in monochrome to be discharged without undergoing OHP processing. Thus, the printing speed of the printer is not lowered unnecessarily.

Figure 9:
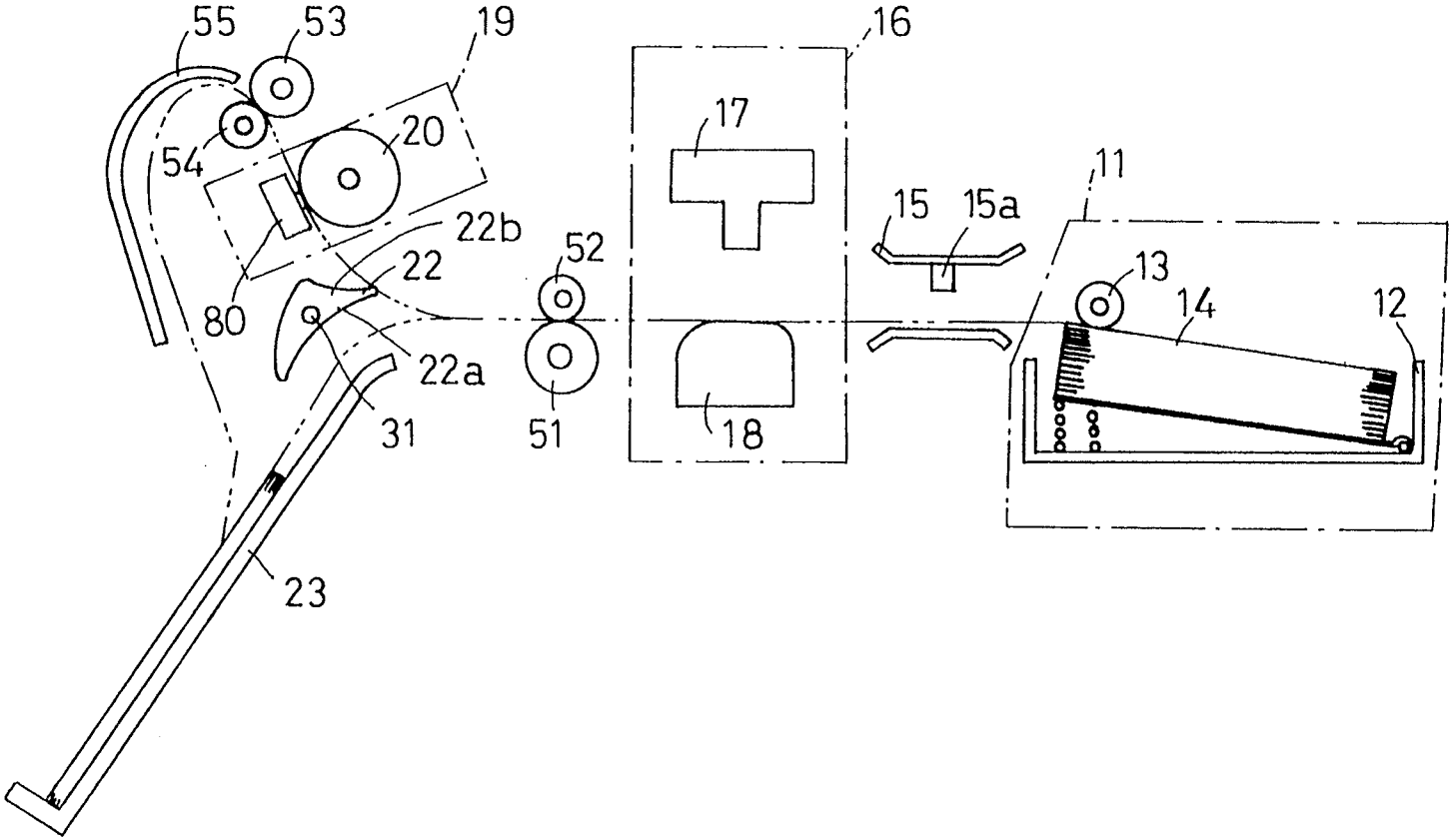
FIG. 9 is a schematic cross-sectional view of a printing apparatus in a third embodiment according to the invention.
Figure 10:
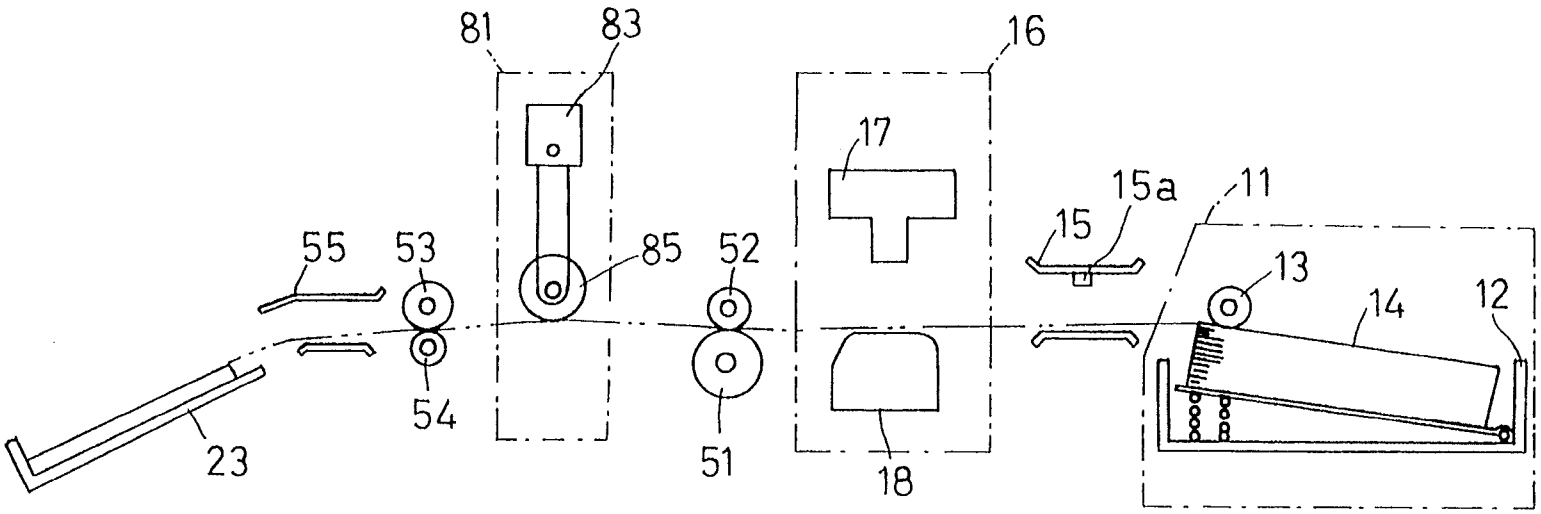
FIG. 10 is a schematic cross-sectional view of a printing apparatus in a fourth embodiment according to the invention.

In the preferred embodiment and modification described above, the OHP processing units 19 and 56 use the nip pressure roller 58 and the pressure roller 57 to perform the OHP processing by pressurizing sheets. Another modification is shown in FIG. 9, in which the OHP processing is achieved by a heating head 80 for heating the unprinted-side surface of OHP sheets printed in color. The heating action flattens ink protrusions on the printed sheet surface. A further modification is depicted in FIG. 10. In place of the pressure roller and nip pressure roller described with reference to FIG. 5, a printer in the modification of FIG. 10 may be provided with a coating device 81 capable of applying a coat of suitable coating material over the printed surface of OHP sheets printed in color. A solenoid 83 presses a coater 85 towards any sheet requiring OHP processing or detaches the coater 85 from any sheet not requiring OHP processing. The coating smooths out any ink protrusions on the printed sheet surface.

As apparent from the above description, the printing apparatus according to the invention enhances the light transmittance of OHP sheets while preventing any deterioration in printing speed.

While the preferred embodiment and modifications of the invention have been described using specific terms, such description is for illustrative purposes only, and it is to be understood that changes and variations may be made without departing from the spirit or scope of the following claims.

What is claimed is:

1. A printing apparatus comprising:

printing means for performing printing in a plurality of colors including black;

overhead projector-oriented processing means for enhancing light transmittance of an overhead projector-ready sheet on which said printing means prints print data, including flattening means for flattening any protrusions of ink printed on the sheet;

color judging means for making one of two color judgments, one color judgment being that data printed on said overhead projector-ready sheet are in black monochrome, the other color judgment being that data printed on said overhead projector-ready sheet are in a plurality of colors; and controlling means for controlling said overhead projector-oriented processing means in accordance with the one of two color judgments made by said color judging means;

wherein said controlling means activates said overhead projector-oriented processing means if said color judging means finds the print data to be in a plurality of colors, and said controlling means deactivates said overhead projector-oriented processing means if said color judging means finds the print data to be in black monochrome.

2. The printing apparatus according to claim 1, wherein said printing means contains an ink jet head for jetting ink onto said overhead projector-ready sheet for printing.

3. The printing apparatus according to claim 2, wherein said flattening processing means comprises a pressure roller arrangement for pressing the overhead projector-ready sheet after printing by said printing means with the ink, whereby any protrusions of the ink printed on the sheet are flattened.

4. A printing apparatus according to claim 3, further comprising roller positioning means for positioning said pressure roller arrangement in one of two positions, one position being such that said pressure roller arrangement is pressed against the overhead projector-ready sheet to smooth out any ink protrusions thereon if the printing is found to be in a plurality of colors, the other position being such that said pressure roller arrangement is moved away from the overhead projector-ready sheet to suppress smoothing of any ink protrusions.

5. The printing apparatus according to claim 2, wherein said flattening processing means comprises heating means for heating the overhead projector-ready sheet after printing by said printing means with the ink, whereby any protrusions of the ink printed on the sheet are flattened.

6. The printing apparatus according to claim 2, wherein said flattening processing means comprises coating means for applying a coat of coating material onto the overhead projector-ready sheet after printing by said printing means with the ink, whereby any protrusions of the ink printed on the sheet are flattened.

7. A printing apparatus according to claim 2, further comprising route switching means for selecting one of a first paper feeding route and a second paper feeding route, the first paper feeding route including said overhead projector-oriented processing means, the second paper feeding route being free of said overhead projector-oriented processing means, said route switching means selecting the first paper feeding route if the printing is found to be in a plurality of colors and said route switching means selecting the second paper feeding route if the printing is found to be in black monochrome.

8. A printing apparatus according to claim 7, further comprising an interface through which a host computer inputs said print data.

9. A printing apparatus according to claim 2, further comprising sheet judging means for making one of two sheet judgments, one sheet judgment being that the sheet on which print data is to be printed is an overhead projector-ready sheet, the other sheet judgment being that the sheet on which print data is to be printed is an ordinary sheet, said overhead projector-oriented processing means performing overhead projector-oriented processing if said sheet judging means judges that the sheet on which print data is to be printed is the overhead projector-ready sheet.

10. A printing apparatus according to claim 9, further comprising route switching means for selecting one of a first paper feeding route and a second paper feeding route, the first paper feeding route including said overhead projector-oriented processing means, the second paper feeding route being free of said overhead projector-oriented processing means, said route switching means selecting the first paper feeding route if said sheet judging means judges that the sheet to be printed is the overhead projector-ready sheet and said color judging means judges that data printed on said overhead projector-ready sheet is in a plurality of colors, said route switching means selecting the second paper feeding route if any of said sheet judging means judges that the sheet to be printed is the ordinary sheet and said color judging means judges that data printed on said overhead projector-ready sheet is in black monochrome.

11. A printing apparatus comprising:

a printer head having a plurality of nozzles filled individually with ink of a plurality of colors including black, said printer head causing the plurality of nozzles selectively to jet the ink therewithin onto a print medium for multiple color printing;

a platen disposed opposite to said printer head, said platen holding the print medium in place;

first judging means located along a route through which the print medium is moved toward said platen, said first judging means making one of two judgments, one judgment being that the print medium is an overhead projector-ready sheet, the other judgment being that the print medium is an ordinary sheet;

overhead projector-oriented processing means located downstream of said platen, said overhead projector-oriented processing means enhancing light transmittance of the ink on the print medium after printing by said printer head;

a printed paper tray located downstream of said platen, said printed paper tray accommodating the print medium after printing by said printer head;

route switching means for selecting one of a first paper feeding route and a second paper feeding route, the first paper feeding route being one through which the print medium, after printing by said printer head, is sent via said overhead projector-oriented processing means to said printed paper tray, the second paper feeding route being one through which the print medium, after printing by said printer head, is sent to said printed paper tray without passage through said overhead projector-oriented processing means; and second judging means for making one of two judgments, one judgment being that the data printed by said printer head are in black monochrome, the other judgment being that the data printed by said printer head are in a plurality of colors;

wherein said route switching means selects the first paper feeding route if said first judging means judges that the print medium is the overhead projector-ready sheet and if said second judging means judges that the data printed by said printer head are in a plurality of colors, and the print medium is forwarded through the selected first paper feeding route for processing by said overhead projector-oriented processing means.

12. The printing apparatus according to claim 11, wherein said route switching means selects the second paper feeding route when any of two conditions is determined, one condition being that said first judging means judges the print medium to be an ordinary sheet, the other condition being that said second judging means judges the data printed are in black monochrome, and the print medium after printing is forwarded through the selected second paper feeding route and into said printed paper tray without passage through said overhead projector-oriented processing means.

13. The printing apparatus according to claim 12, wherein said overhead projector-oriented processing means comprises heating means for heating the overhead projector-ready sheet after printing by said printer head, whereby any ink protrusions on the sheet are smoothed out.

14. The printing apparatus according to claim 12, wherein said overhead projector-oriented processing means comprises a pressure roller arrangement for pressing the overhead projector-ready sheet after printing by said printer head, whereby any ink protrusions on the sheet are flattened.

15. The printing apparatus according to claim 14, further comprising roller positioning means for positioning said pressure roller arrangement in one of two positions, one position being such that said pressure roller arrangement is pressed against the overhead projector-ready sheet to flatten any ink protrusions and the other position being such that said pressure roller arrangement is moved away from the overhead projector-ready sheet to suppress flattening of any ink protrusions.

16. The printing apparatus according to claim 12, wherein said overhead projector-oriented processing means comprises coating means for applying a coat of coating material onto the overhead projector-ready sheet after printing by said printer head, whereby any ink protrusions are flattened.

17. A printing apparatus comprising:

a printer head having a plurality of nozzles filled individually with ink of a plurality of colors including black, said printer head causing the plurality of nozzles selectively to jet the ink therewithin onto a print medium for multiple color printing;

a platen disposed opposite to said printer head, said platen holding the print medium in place;

first judging means located along a route through which the print medium is moved toward said platen, said first judging means making one of two judgments, one judgment being that the print medium is an overhead projector-ready sheet, the other judgment being that the print medium is an ordinary sheet;

overhead projector-oriented processing means located downstream of said platen, said overhead projector-oriented processing means for processing the print medium to enhance light transmittance of the ink on the print medium after printing by said printer head;

a printed paper tray located downstream of said platen, said printed paper tray accommodating the print medium after printing by said printer head; and second judging means for making one of two judgments, one judgment being that data printed by said printer head are in black monochrome, the other judgment being that data printed by said printer head are in a plurality of colors;

wherein said overhead projector-oriented processing means processes the print medium after printing if said first judging means judges the print medium to be the overhead projector-ready sheet and if said second judging means judges the data printed by said printer head are in a plurality of colors.

18. The printing apparatus according to claim 17, further comprising route switching means is provided at a location between said first judging means and said second judging means and said overhead projector-oriented processing means, said route switching means selecting one of a first paper feeding route and a second paper feeding route, said first paper feeding route containing said overhead projector-oriented processing means, said route switching means selecting said first paper feeding route when said first judging means judges that the print medium is an overhead projector-ready sheet and said second judging means judges that the data printed by said printer head is in a plurality of colors.

19. The printing apparatus according to claim 18, wherein said route switching means includes a divider assembly, said divider assembly including a divider shaft having a plurality of spaced dividers thereon, a solenoid, a solenoid lever having one end attached to said solenoid, said solenoid lever having another end attached to an end of said divider shaft, a tension spring for actuating said solenoid lever, and a stopper for contacting said solenoid lever, wherein when said solenoid is actuated, said solenoid lever divider shaft and dividers rotate to prevent said print medium from being guided to said first paper feeding route, and when said solenoid is not actuated, said print medium is guided to said second paper feeding route.

* * * * *